US005622452A

United States Patent [19]

Goldman

[11] Patent Number: 5,622,452

[45] Date of Patent: Apr. 22, 1997

[54] JACK-UP RIG WITH IMPROVED RACK CHOCK ASSEMBLY

[76] Inventor: Jerome L. Goldman, 935 Gravier St., Suite 2100, New Orleans, La. 70112

[21] Appl. No.: 531,513

[22] Filed: Sep. 21, 1995

[51] Int. Cl.[6] ..... E02B 17/06

[52] U.S. Cl. ..... 405/198; 405/196; 254/112

[58] Field of Search ..... 405/195.1–200, 405/203, 204, 209; 254/106–112

[56] References Cited

U.S. PATENT DOCUMENTS

| | | | |
|---|---|---|---|
| 2,966,336 | 12/1960 | Owen | 405/197 X |
| 4,255,069 | 3/1981 | Yielding | 405/198 X |
| 4,269,543 | 5/1981 | Goldman et al. | 405/198 |
| 4,479,401 | 10/1984 | Korkut | 405/198 X |
| 4,589,799 | 5/1986 | Hotta et al. | 405/196 |
| 4,662,787 | 5/1987 | Tatsuguchi | 405/198 |
| 5,139,366 | 8/1992 | Choate et al. | 405/196 X |

*Primary Examiner*—Dennis L. Taylor

[57] ABSTRACT

The invention relates to a jack-up rig unit for offshore use which has a floatable hull supportable by one or more legs above a water line, a jack-up unit for elevating the hull and a rack chock assembly for rigidly locking the legs to the hull without introducing substantial bending moments in the legs. The rack chock assembly is laterally movable into and out of engagement with respect to the legs and, in case of a lock-up between the leg and the rack chock assembly, the invention provides for the use of a wedge member incorporated into a rack chock assembly, with a wedge member adapted for a limited sliding movement in relation to a longitudinal axis of the leg, so as to break locked engagement between the teeth of the rack chock assembly and the leg.

22 Claims, 2 Drawing Sheets

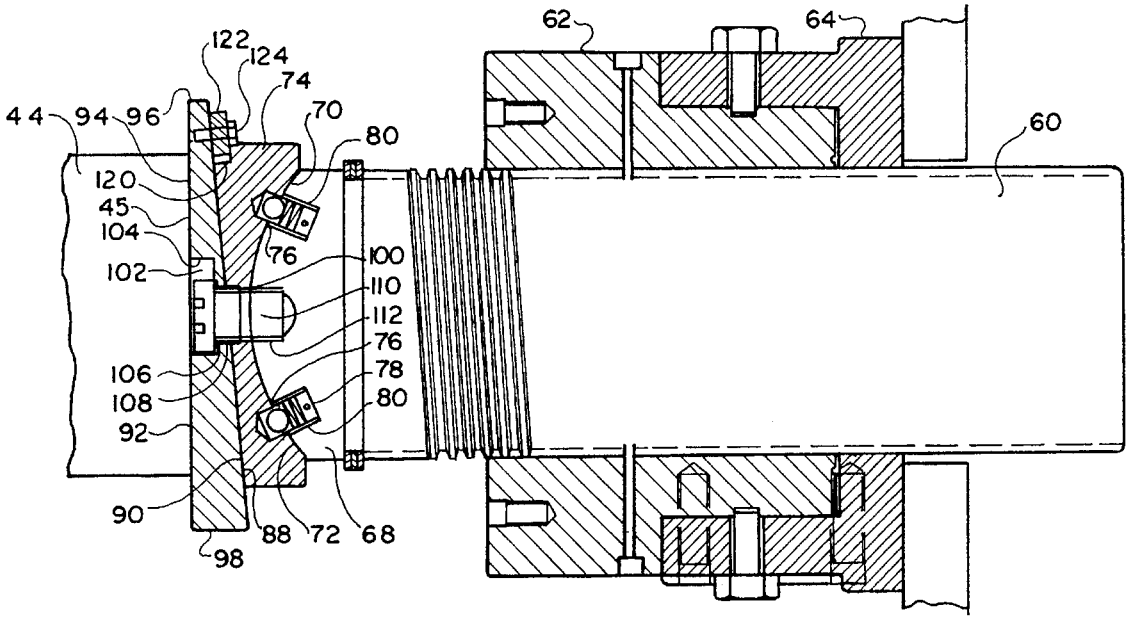
FIG. 3
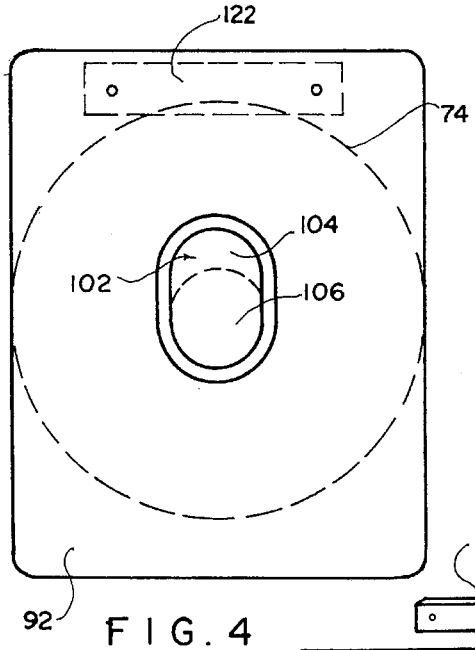
FIG. 4
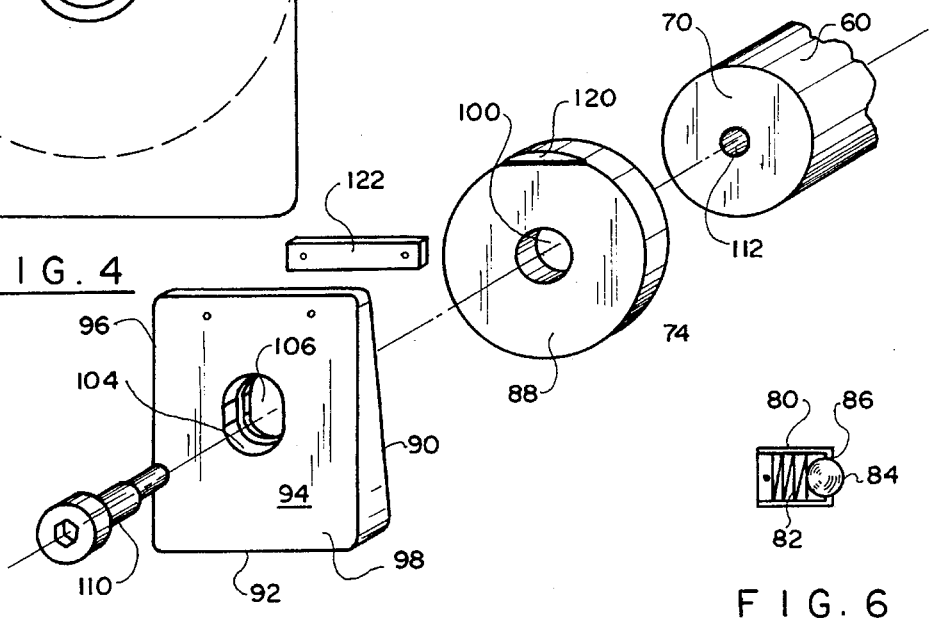
FIG. 5
FIG. 6

JACK-UP RIG WITH IMPROVED RACK CHOCK ASSEMBLY

BACKGROUND OF THE INVENTION

The present invention relates to self-elevating jack-up rigs for offshore oil exploration and production, and more particularly to a system utilizing an improved rack chock assembly for support legs.

The term "Jack-Up Rig Unit" is used in the art to identify a working platform adapted for conducting drilling, workover, production and other offshore operations. Such platforms are supported in an elevated position above the water line by a number of jackable legs which are adapted to move relative to a hull and allow towing of the platform to a desired location with the legs elevated above the hull. Once on the location, the legs are lowered to the bottom of a body of water, while supporting the hull in its desired elevated position.

One of such rigs and associate leg/hull rack chock system is disclosed in my earlier U.S. Pat. No. Re. 32,589, re-issued on Feb. 2, 1988, a full disclosure of which is incorporated by reference herein. That patent disclosed a method and apparatus for rigidly supporting the jack-up unit in an elevated position on the legs of the unit and/or for rigidly supporting the legs in a raised position when the unit is afloat. In accordance with the disclosure of that patent, rack teeth of the supporting leg are engaged with opposed, matching rack sections of a rack chock which can be moved for adjustment vertically up and down, as well as laterally in and out of engagement with the leg chord. The rack chock system of U.S. Pat. No. Re. 32,589 proved to be structurally successful because it provides a system of interdigitation of the teeth on the rack chock and the legs which engages the hull with the legs without introducing any substantial bending moments on the legs.

However, there exists a certain difficulty in breaking the rigid engagement between the teeth of the rack chock and the legs to allow withdrawal of the rack chock and movement of the legs in relation to the hull, when the conditions so require. The horizontal screw jacks have a tendency, under certain conditions, to lock-up against the chock and require more torque than is available to initiate withdrawal of the screw jacks. It is believed that the locking-up of the chock pressing against the screw jack is caused by forces and moments in the legs, which result from the chock moving away from the rack when loaded. This is most likely to occur when the rig is elevated above the sea surface and experiences a major storm. Sometimes it occurs after a rig is afloat in heavy seas and the vessel experiences a great deal of pitching and rolling. The vertical screw jacks which move the rack chock up or down in relation to the legs do not experience this locking-up phenomenon under the above stated conditions.

As a result of the locking-up of the rack chock, the rig personnel looses valuable time in an attempt to free up one or more horizontal screw jacks. The usual procedure which is used now is to destroy a cap which is pressed against the chock by a horizontal screw and withdraw the screw jack and the rack. The cap is then replaced before the screw jack is moved laterally to move the chock into an engagement with the leg teeth.

The present invention contemplates elimination of the drawbacks associated with the undesirable locking-up of the chock and provision of an improved rack chock assembly where the locking-up phenomenon of the screw jacks against the chock is minimized or altogether eliminated.

SUMMARY OF THE INVENTION

It is, therefore, an object of the present invention to provide a jack-up rig with improved rack chock assembly.

It is another object of the present invention to provide an improved rack chock assembly which prevents locking-up of the horizontal screw in relation to a leg chord.

It is a further object of the present invention to provide an improved jack-up rig assembly, wherein the locking-up of the horizontal screw jacks is eliminated.

These and other objects of the present invention are achieved through a provision of a jack-up rig unit for offshore use which comprises a floatable hull supportable by at least one leg above a water line, a means carried by the hull for rigidly locking the leg to said hull while preventing substantial bending moments to be introduced in the leg, the locking means comprising a rack chock assembly which is laterally movable into and out of engagement with respect to the leg. In case of a lock-up of the rack chock assembly to the leg, the present invention contemplates provision of a means carried by the rack chock assembly for breaking locked engagement between the leg and the hull.

In a preferred embodiment, the means for breaking locked engagement comprises a wedge member provided with a tapered surface and incorporated into a rack chock assembly. The rack chock assembly is provided with a contact surface oriented at an acute angle in relation to a longitudinal axis of the leg, and the wedge member is fitted, side-by-side, in engagement with the contact surface.

Conventionally, the rack chock assembly comprises a chock member with teeth on one of its surfaces for rigidly engaging teeth of the leg (s) and a screw jack for moving the chock member into and out of engagement with the teeth of the leg. The wedge member is fitted between the chock member and the screw jack and is allowed to slide transversely to a longitudinal axis of the screw jack, so as to break the locked engagement and allow to change a relative distance between the chock member and the screw jack.

The screw jack usually comprises an elongated screw shaft having a spherical end and a screw cap with a spherical seat, the radius of which matches the radius of the spherical end of the shaft. The wedge member and the cap are secured together to the screw shaft by a central bolt engaged respective openings in the wedge member, the cap end and the screw shaft.

The wedge member and the cap are adapted for a rotational movement about the axis of the bolt while prevented from disengagement from the screw shaft by the bolt. To facilitate rotational movement of the wedge member and the cap, which depends on the direction in which the locked engagement is to be broken, one or more spring loaded ball catches are fitted between the end of the screw shaft and the cap.

BRIEF DESCRIPTION OF THE DRAWINGS

Reference will now be made to the drawings, wherein like parts are designated by like numerals, and wherein:

FIG. 3 is a detail, partially cross-sectional view of a horizontal screw jack assembly in accordance with the present invention.

FIG. 4 is a plan view of a wedge member and a cap.

FIG. 5 is an exploded view of the wedge member/cap/screw shaft connection; and

FIG. 6 is a detail view of a spring-loaded ball catch.

DETAILED DESCRIPTION OF THE PREFERRED EMBODIMENT

Figure 2:
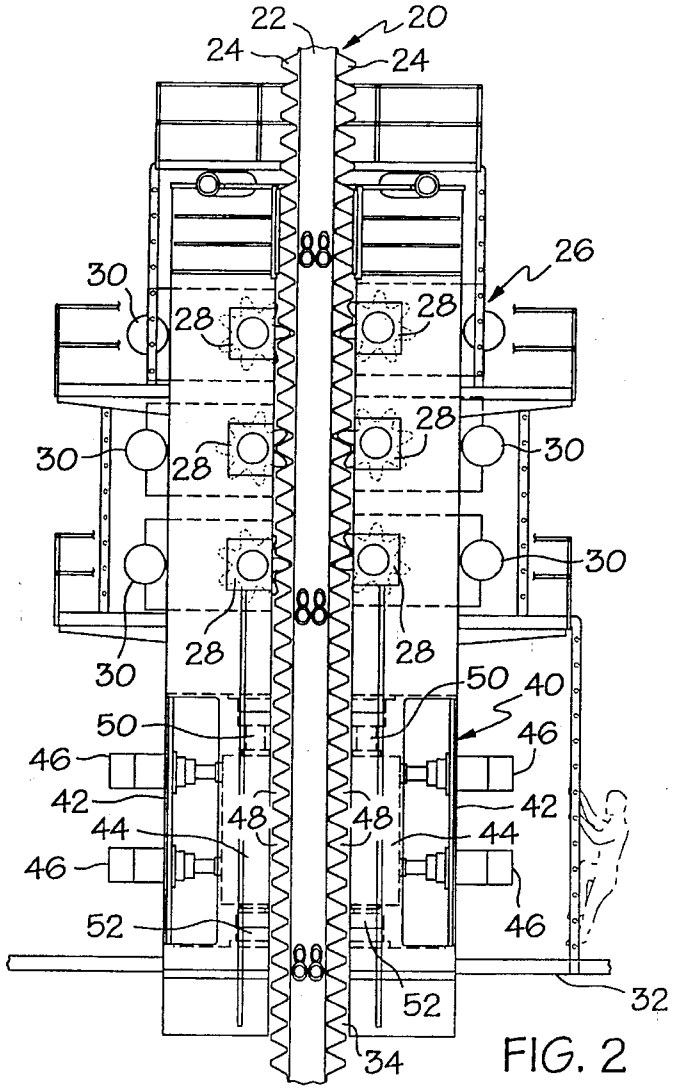
FIG. 2 is a vertical schematic view of a leg chord illustrating position of a jacking assembly and a rack chock assembly in relation to the hull.
Figure 1:
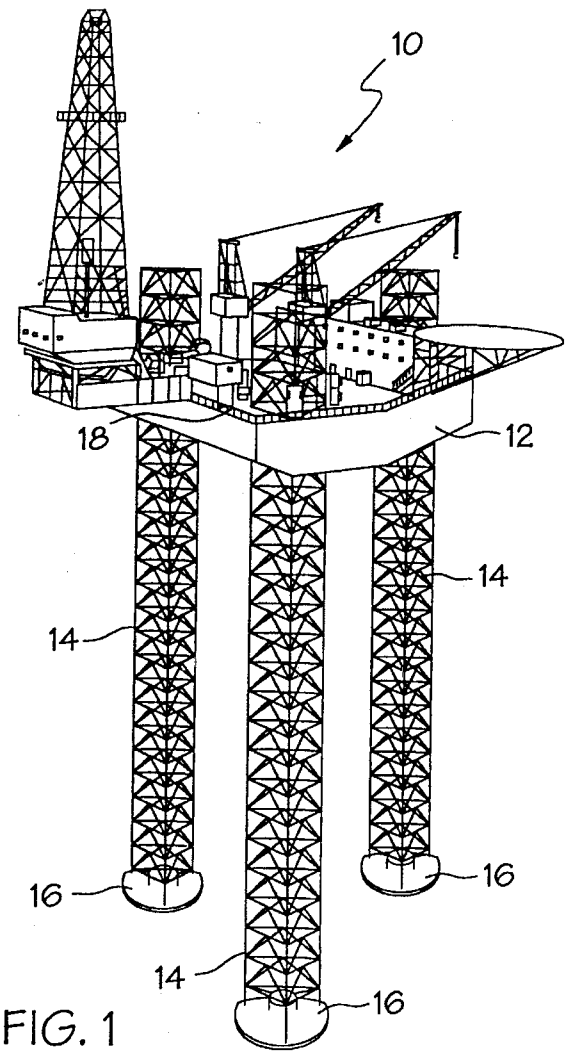
FIG. 1 is a schematic view of a jack-up drilling rig in an elevated position.

Turning now to the drawings in more detail, numeral 10 designates a jack-up rig unit schematically shown in an elevated position, with the hull 12 of the platform supported by three legs 14 above a water line. The legs can rest on the bottom of a body of water, such as by welding the bottom of a leg truss to a footing 16. Jacks and rack chocks 18 are positioned on the deck of the hull 12 and extend, to some degree, through the body of the hull. The platform usually supports living quarters for the personnel, cranes, helicopter landing deck and other structures conventionally found on an offshore rig.

Each leg 14 has a number of leg chords 20, with each chord having a chord rack 22 which carries a plurality of horizontally extending teeth 24 on opposite sides of the chord rack 22. The raising and lowering of the legs is accomplished by a jacking system 26 which utilizes driving pinions 28 driven by jacks 30. The jacking system is provided with a number of jack pinions for engaging opposite teeth of each chord rack 22.

Once the hull is elevated to the desired position, the rack chock system 30 in accordance with the present invention is engaged. Each rack chock system can be located above the deck 32 of the hull 12 or extend into a leg well 34 of the hull. Each rack chock system 40 utilizes a rack chock assembly for each set of teeth on the chord rack 22.

In the embodiment shown in FIG. 2, two laterally opposed rack chock assemblies 42 are shown. Provision of two rack chocks on each leg chord rack equalizes horizontal forces acting on the leg during operation of the platform and minimizes bending forces acting on the leg, while rigidly engaging the hull 12 with the platform legs 14. Laterally movable screws 46, of the rack chock assembly 42 allow movement of a chock 44 in a lateral direction into engagement with the teeth 24 of the leg 20 and out of engagement with the teeth.

Each chock 44 is provided with a plurality of teeth 48 which match the teeth on the leg 20, so as to achieve a rigid engagement between the rack chock assembly 42 and the legs 14. The rack chock assembly 42 is carried by the hull 12 of the platform, as a result of which the hull and legs become rigidly engaged. Once the teeth 48 on the chock 44 are aligned in a horizontal plane with the teeth 24, upper and lower elevating screws 50 and 52, respectively, are moved into contact with their respective chocks 44 and move the chocks 44 into a more precise engagement with the teeth 24 of the chord rack 22. After a total alignment and matching engagement has been achieved, the load is totally transferred from the jacking system 26 to the rack chock assembly 32 by releasing the jack screws. As will be appreciated by those skilled in the art, the number and shape of engaging teeth on the leg chord and the rack chock assembly as well as the size of the teeth and the spacing between the adjacent teeth can be varied.

Turning now to FIG. 3, a detail view of an improved rack chock assembly in accordance with the present invention is shown. As can be seen in the drawing, a rack chock screw shaft 60 is adapted for threadable engagement with a screw support member 62 within which the shaft extends. The bushing 62 is engaged with a foundation 64 in a secure manner, with the portion of the foundation and the bushing internally threaded to allow threadable engagement with the screw shaft 60.

When the bushing is rotated, the screw shaft 60 moves, in relation to the chock 34, so as to cause engagement of the chock teeth 48 with the leg teeth 24. The screw shaft 60 has a forward end 68 formed with a spherical end surface 70 which contacts a matchingly spherical seat 72 of a cap 74. The cap 74 can be rotated 180 degrees about a longitudinal axis of a screw shaft 60, the purpose of which will be described below hereinafter.

To facilitate such a rotational movement, the seat 72 of the cap 74 is provided with one or more cutouts, or indentations 76 which are aligned with cutouts 78 formed in the end 68 of the screw shaft 60. A cylindrical retainer tube 80 (See FIG. 3); is fitted in each of the openings 78 in the manner shown in FIG. 4. The retainer tube 80 houses a compressed coil spring 82 which urges, with one of its ends, against a ball bearing 84 fitted between a partially closed end 86 of the retainer tube 80. The ball bearing 84, being greater in diameter than an opening formed by the partially closed end 86 is prevented from exiting the retainer tube 80, while part of the ball bearing 84 contacts the seat 72 of the cap 74 and partially extends into an opening 76 in the seat 74. The spring loaded ball catches allow rotation of the cap 74, 180 degrees, when required.

An opposite contact surface 88 of the cap 74 is tapered, as shown in FIG. 3, and contacts a matchingly tapered surface 90 of a wedge member 92. The wedge member 92 is fitted between the chock 44 and the cap 74 to facilitate breaking off of the engagement between the teeth 24 of the legs and the chock 44 in case of the teeth locking-up during certain operational conditions.

The wedge member 92 has a tapered surface 90 and a generally straight opposite surface 94 which contacts the chock 44. In FIG. 3, the wedge member 92 is oriented with its thin end 96 forming an upper part of the wedge, and with its thicker end 98 forming the lower part. As will be described below, the orientation of the slanted portion of the wedge member 92 can be changed.

A central opening 100 is formed in the cap 74 and extends through the entire width of the cap 74 in an alignment with a central opening 102 formed in the wedge member 92. The opening 102 has an outer portion 104 and an inner portion 106 which has a diameter smaller than the outer portion 104. The diameter of the opening portion 106 is substantially equal to the diameter of the opening 100 in the cap 92.

A retainer bolt sleeve 108 is fitted into the portion 106 of the opening 102 and extends, to some degree, into the opening 100. A bolt 110 extends through the outer portion 104 into the sleeve 108 and into the opening 100 formed in the cap 74. A similarly sized central opening 112 is formed in the center of the screw shaft 60 allowing to receive a part of the bolt 110 therein. It is preferred that the bolt 110 not be tightly engaged within the openings 100, 104, 106, and 112 to allow some lateral "play" of the cap 74 and the wedge member 92.

A head of the bolt 110 is greater than the diameter of the opening portion 106 but smaller than the diameter of the opening portion 104, thus preventing the bolt 110 to extend more than necessary into the screw shaft 60. As can be better seen in FIGS. 4 and 5, the portion 104 of the opening 102 is made elongated, or oval, to allow the wedge member 96 to move, for a limited distance, in relation to the cap 74, that is allowing the tapered surface 90 of the wedge member 92 to slide against the tapered contact surface 88 of the cap 74.

A cutout 120 is formed in the contact surface 88 of the cap 74 to accommodate a part of a retainer plate 122 fitted between the surface 90 and the cap 74 adjacent to a thinner end 96 of the wedge member 92. The retainer plate can be secured by one or more shear bolts 124 after the cap 74 has been assembled with the screw shaft 60 and can be used as a template to drill holes in the wedge member 92. The retainer plate 122 prevents the wedge member 92 from moving downward relative to the cap 74. The retainer plate 122 is removed when the hull 12 is jacked up on a drill site so as to facilitate separation of the cap 74 from the wedge member 92 and withdrawal of the screw shaft 60.

When assembled, the improved rack chock assembly in accordance with the present invention will use the wedge member 92 fitted between the tapered surface 88 of the spherical cap 74 and a teeth-free surface 45 of the chock 44. The wedge member 92 allows to break locked engagement between the chock 44 and the leg 14, particularly between the horizontal screws 60 and the legs 14. Both the contact surface 88 and the surface 90 of the wedge member 92 are oriented at an angle in relation to a longitudinal axis of the screw shaft 60 and are oriented at an acute angle to a longitudinal axis of the legs 14. The wedge member 92 slides, allowing a limited longitudinal movement of the wedge member against the cap 74 within the dimensions of the opening 104.

In operation when the horizontal screw jack is locked up, and it is necessary to lower the hull into the water, the vertical jacks are slightly withdrawn and the hull 12 is lowered, to a limited distance, by the jacking system. Then the wedge member 92 slides down between the chock 44 and the cap 74 changing the distance between the chock and the screw shaft 60, thereby allowing a lateral movement of the chock in relation to the leg rack breaking the locked engagement between the legs 14 and the hull. Then the hull can be lowered into the water. When the rack chock is engaged in the desired position of the hull, the wedge automatically slides into the correct position.

During tow conditions, the wedge member 92 is rotated 180 degrees by turning the cap 74 and the wedge member 92 against the pressure of the coil spring 82. Once the thicker end 98 assumes an upper position, the cap again can be secured in place by tightening the bolt 110 which has been loosened to allow rotation of the cap 74 and the wedge member 92.

When the rig is afloat, the leg 18 experiences a downward gravity load which is supported by the bottom vertical screw jacks 52, with the vertical screw jacks 50 carrying no load. When the rig is in the elevated position, the gravity weight on the rig is supported by the upper vertical screw jacks 50, while the lower screw jack 52 can be backed off, if necessary. By slightly lowering the hull, the load can be taken off the upper screw jacks 50, and a locked-up horizontal screw jacks 46 will become loose as the wedge member 92 slides against the cap 74 and the chock 44.

It is preferred that during elevation of the hull, the thin end 96 of the wedge member 92 is oriented so as to form an upper part of the wedge member, with reversal of the relative position between the ends 96 and 98 for the tow or afloat conditions.

Many changes and modifications can be made in the design of the present invention without departing from the spirit thereof. I, therefore, pray that my rights to the present invention be limited only by the scope of the appended claims.

I claim:

1. A jack-up rig unit for offshore use, comprising:

a floatable hull supportable by at least one leg above a water line;

a means carried by said hull for rigidly locking with at least one leg of said hull, said locking means comprising a rack chock assembly laterally movable into an out of engagement with respect to said at least one leg; and a means carried by said rack chock assembly for breaking locked engagement between said at least one leg and said hull.

2. The unit of claim 1, wherein said rack chock assembly is provided with a contact surface which is oriented at an acute angle in relation to a longitudinal axis of said at least one leg.

3. The unit of claim 2, wherein said means for breaking locked engagement comprises a wedge member provided with a tapered surface considered for mating juxtaposition with said contact surface.

4. The unit of claim 3, wherein said wedge member is adapted for a limited sliding movement in relation to said contact surface.

5. The unit of claim 1, wherein said rack chock assembly comprises a chock member provided with teeth on one of its surfaces for rigidly engaging teeth of said at least one leg and at least one screw jack for moving said chock member, and wherein said means for breaking locked engagement is positioned between said screw jack and said chock member.

6. The unit of claim 5, wherein said means for breaking locked engagement comprises a wedge member having at least one tapered surface.

7. The unit of claim 6, wherein said wedge member is mounted for a limited sliding movement in relation to said chock member.

8. The unit of claim 5, wherein said at least one screw jack comprises an elongated screw shaft provided with exterior threads and a spherical end, a screw cap having a spherical seat for engaging said spherical end, and a tapered surface formed on said screw cap opposite said spherical seat.

9. The unit of claim 8, wherein said means for breaking locked engagement comprises a wedge member provided with a tapered surface configured for mating juxtaposition with a tapered surface of said screw cap.

10. The unit of claim 9, wherein said screw cap is provided with a central aperture of a discrete diameter and said wedge member is formed with a central elongated opening having greater dimensions than said aperture, said aperture and said opening receiving a securing bolt therethrough, said bolt allowing a limited longitudinal sliding movement of said wedge member in relation to said screw cap while preventing disengagement of said wedge member from said screw cap.

11. The unit of claim 10, further comprising means for allowing a rotational movement of said wedge member and said cap in relation to a longitudinal axis of said screw shaft.

12. The unit of claim 11, wherein said means for allowing rotational movement comprises at least one ball bearing urged into a contact with said spherical seat by a compressed spring fitted into an opening formed in said spherical end of said screw shaft.

13. The unit of claim 11, wherein said means for allowing rotational movement comprises a pair of diametrically opposed ball bearings, each ball bearing fitted into a respective cutout formed in said spherical seat and retained in place between said seat and said end of said screw shaft by a compressed coil spring fitted into an opening formed in said spherical end of the screw shaft.

14. A jack-up rig unit for offshore use, comprising:

a floatable hull supportable by at least one leg above a water line;

a means carried by said hull for rigidly locking said at least one leg to said hull, said locking means comprising a rack chock assembly laterally movable into and out of engagement with respect to said at least one leg, said rack chock assembly being provided with a contact surface which is oriented at an acute angle in relation to a longitudinal axis of said at least one leg; and a means carried by said rack chock assembly for breaking locked engagement between said at least one leg and said hull, said means for breaking locked engagement comprising a wedge member provided with a tapered surface configured for mating juxtaposition with said contact surface.

15. The unit of claim 14, wherein said wedge member is adapted for a limited sliding movement in relation to said contact surface, thereby allowing to vary a relative distance between said at least one leg and said contact surface.

16. A jack-up rig unit for offshore use, comprising:

a floatable hull supportable by at least one leg above a water line;

a means carried by said hull for rigidly locking said at least one leg to said hull, said locking means comprising a rack chock assembly laterally movable into and out of engagement with respect to said at least one leg, said rack chock assembly comprising a chock member provided with teeth on one of its surfaces for rigidly engaging teeth of said at least one leg and at least one screw jack for moving said chock member; and a means carried by said rack chock assembly for breaking locked engagement between said at least one leg and said hull, said means for breaking locked engagement being positioned between said screw jack and said chock member.

17. The unit of claim 16, wherein said means for breaking locked engagement comprises a wedge member having at least one tapered surface, said wedge member mounted for a limited sliding movement in relation to said chock member, thereby allowing to vary a relative distance between said chock member and said at least one screw jack.

18. The unit of claim 16, wherein said at least one screw jack comprises an elongated screw shaft provided with exterior threads and a spherical end, a screw cap having a spherical seat for engaging said spherical end, and a tapered surface formed on said screw cap opposite said spherical seat, and wherein said means for breaking locked engagement comprises a wedge member provided with a tapered surface configured for mating juxtaposition with the tapered surface of said screw cap.

19. The unit of claim 18, wherein said screw cap is provided with a central aperture of a discrete diameter and said wedge member is formed with a central elongated opening having greater dimensions than said aperture, said aperture and said opening receiving a securing bolt therethrough, said bolt allowing a limited longitudinal sliding movement of said wedge member in relation to said screw cap while preventing disengagement of said wedge member from said screw cap.

20. The unit of claim 19, further comprising a means for allowing a rotational movement of said wedge member and said cap in relation to a longitudinal axis of said screw shaft.

21. The unit of claim 20, wherein said means for allowing rotational movement comprises at least one ball bearing urged into a contact with said spherical seat by a compressed spring fitted into an opening formed in said spherical end of the screw shaft.

22. The unit of claim 20, wherein said means for allowing rotational movement comprises a pair of diametrically opposed ball bearings, each ball bearing fitted into a respective cutout formed in said spherical seat and retained in place between said seat and said end of said screw shaft by a compressed coil spring fitted into an opening formed in said end of the screw shaft.

* * * * *